US006820719B2

(12) United States Patent
Toyoda

(10) Patent No.: US 6,820,719 B2
(45) Date of Patent: Nov. 23, 2004

(54) BUTTERFLY DAMPER

(75) Inventor: Shoichi Toyoda, Tendo (JP)

(73) Assignees: Pioneer Corporation, Tokyo-To (JP); Tohoku Pioneer Corporation, Yamagata-Ken (JP)

( * ) Notice: Subject to any disclaimer, the term of this patent is extended or adjusted under 35 U.S.C. 154(b) by 0 days.

(21) Appl. No.: 10/057,186

(22) Filed: Jan. 23, 2002

(65) Prior Publication Data

US 2002/0144857 A1 Oct. 10, 2002

(30) Foreign Application Priority Data

Feb. 28, 2001 (JP) ..... P2001-55074

(51) Int. Cl.[7] ..... G10K 13/00
(52) U.S. Cl. ..... 181/166
(58) Field of Search ..... 181/163, 164, 181/165, 166, 167, 168, 169, 170

(56) References Cited

U.S. PATENT DOCUMENTS 5,790,682 A 8/1998 Hachiya et al. ..... 381/197
6,144,753 A * 11/2000 Ohyaba et al. ..... 381/405

OTHER PUBLICATIONS

U.S. patent application Ser. No. 10/057,187, Toyoda, filed Jan. 23, 2002.

* cited by examiner

*Primary Examiner*—Kimberly Lockett
(74) *Attorney, Agent, or Firm*—Ladas & Parry LLP

(57) ABSTRACT

A butterfly damper comprises an inner circumferential frame, an outer circumferential frame and at least one arm member. The arm member has one end connected to the outer circumferential frame and the other end connected to the inner circumferential frame. The arm member has a racetrack-shaped cross section.

8 Claims, 3 Drawing Sheets

BUTTERFLY DAMPER

BACKGROUND OF THE INVENTION

1. Field of the Invention

The present invention relates to a butterfly damper for a loudspeaker, and especially to a high-input type butterfly damper.

2. Description of the Related Art

The conventional butterfly damper 7 has a structure having an inner circumferential frame 9, an outer circumferential frame 8 and arm members 10 for connecting the inner circumferential frame 9 and the outer circumferential frame 8 to each other, as shown in FIG. 5. The arm member 10, which has a trapezoidal cross section as shown in FIG. 6, is formed by the injection forming, facilitating formation of the arm member. A voice coil is inserted into the inner circumferential frame 9. The outer circumferential frame 8 is fixed to the other structural component (for example, a framework of the loudspeaker). Excitation of the voice coil causes the inner circumferential frame 9, which is supported by means of the arm members 10 having flexibility, to vibrate together with the voice coil.

The conventional butterfly damper 7 however has a problem that amplitude increased by inputting a high input signal causes stress concentration in the arm member 10, resulting in a state in which the arm member 10 is not able to bear the stress, leading to its breakage or occurrence of rupture. The conventional butterfly damper 7 is not adaptable to the high input signal in this manner.

SUMMARY OF THE INVENTION

An object of the present invention is therefore to provide a butterfly damper, which has a shape feature by which stress can be distributed and reduced, thus permitting to bear a high input signal.

In order to attain the aforementioned object, a butterfly damper according to the first aspect of the present invention comprises:

an inner circumferential frame;

an outer circumferential frame; and at least one arm member having one end connected to said outer circumferential frame and an other end connected to said inner circumferential frame, characterized in that:

said at least one arm member has a racetrack-shaped cross section.

In the present invention, the "racetrack-shaped" cross section means an oval cross section having curved corners with a prescribed radius of curvature like an athletic racetrack, without forming any sharp edges. According to the first aspect of the present invention, the arm member has the racetrack-shaped cross section so as to prevent concentration of stress. The radius of curvature of the racetrack-shaped cross section may vary within the prescribed range by which the stress concentration can be prevented.

In the second aspect of the present invention, each of the one end and the other end of the at least one arm member may have at least one curved surface. According to the second aspect of the present invention, the curved surface is formed at each of the opposite ends of the arm member, which connects the inner circumferential frame and the outer circumferential frame to each other, in the vicinity of which stress concentration tends to occur. It is therefore possible to distribute stress, which is to be applied to the adjacent portion of the arm member as connected, to the end thereof, thus reducing the load of stress and preventing occurrence of fissures or cracks.

In the third aspect of the present invention, a plurality of arm members may be provided as the at least one arm member. According to the third aspect of the present invention, it is possible to make a change in length, width and the other conditions of the arm member to the optimum values in accordance with a level of an input signal value and a size of the butterfly damper. Selection of the appropriate values for these conditions may lead to variation in the number of the arm members. There is no limitation in the number of the arm members.

In the fourth aspect of the present invention, the inner circumferential frame, the outer circumferential frame and the at least one arm member may be formed of resin integrally with each other by an injection forming. According to the forth aspect of the present invention, utilizing the injection forming makes it possible to manufacture the integrally-formed butterfly damper in an easy manner. In the present invention, change in shape of the damper suffices to improve only performance of it without increasing a cost.

In the fifth aspect of the present invention, there may be adopted a structure in which the outer circumferential frame (2) has opposite end surfaces and an inner peripheral surface, the inner peripheral surface being connected to the opposite end surfaces to form opposite connecting edge portions; and the one end of the at least one arm member (4) is connected to a portion of the inner peripheral surface of the outer circumferential frame (2), the portion excluding the opposite connecting edge portions. According to the fifth aspect of the present invention, the one end of the at least one arm member is connected to a portion of the inner peripheral surface of the outer circumferential frame, which excludes the opposite connecting edge portions. Even when operation of the damper causes the inner circumferential frame to oscillate, the above-mentioned portion of the inner peripheral surface of the outer circumferential frame serves as a blocking wall for preventing the arm member from oscillating excessively, thus reducing stress.

DETAILED DESCRIPTION OF THE PREFERRED EMBODIMENTS

Figure 1:
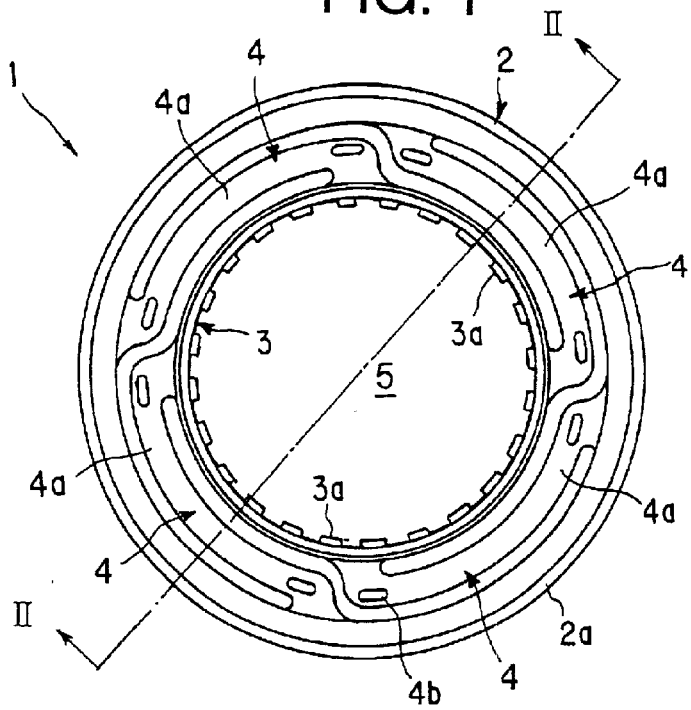
FIG. 1 is a plan view illustrating a butterfly damper of the present invention.
Figure 2:
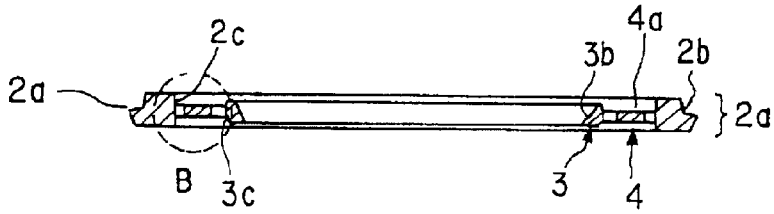
FIG. 2 is a cross-sectional view cut along the line II—II in FIG. 1.
Figure 3:
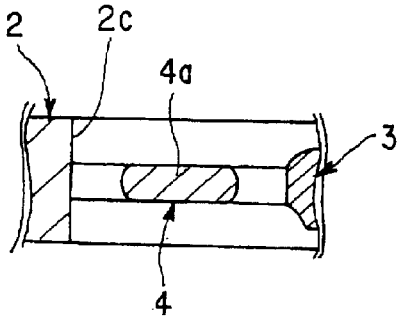
FIG. 3 is an enlarged view illustrating the connecting portion "B" in FIG. 2, by which an arm member and an outer circumferential frame of the butterfly damper of the present invention are connected to each other.
Figure 4:
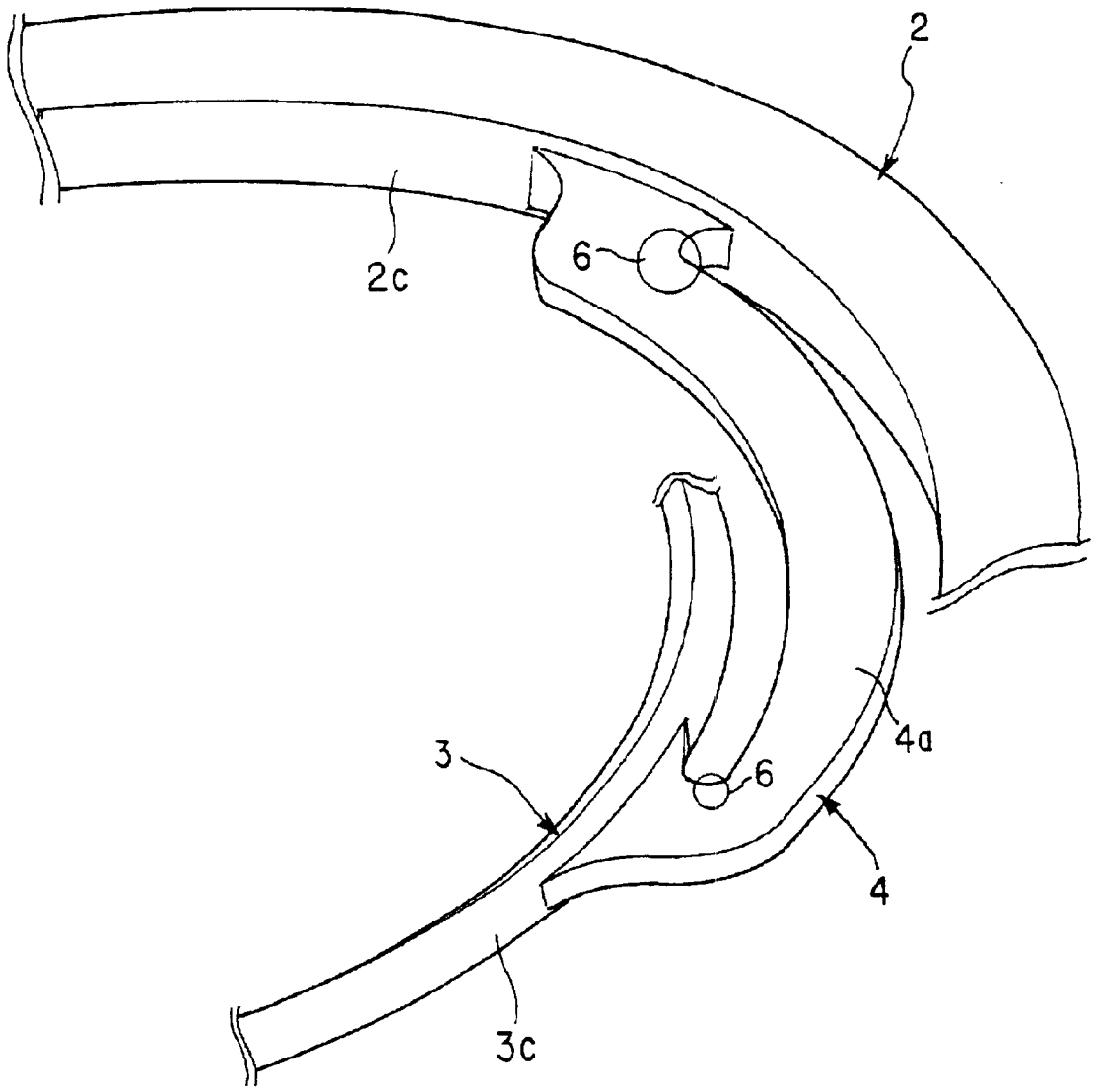
FIG. 4 is a partial perspective view illustrating the butterfly damper of the present invention.
Figure 5:
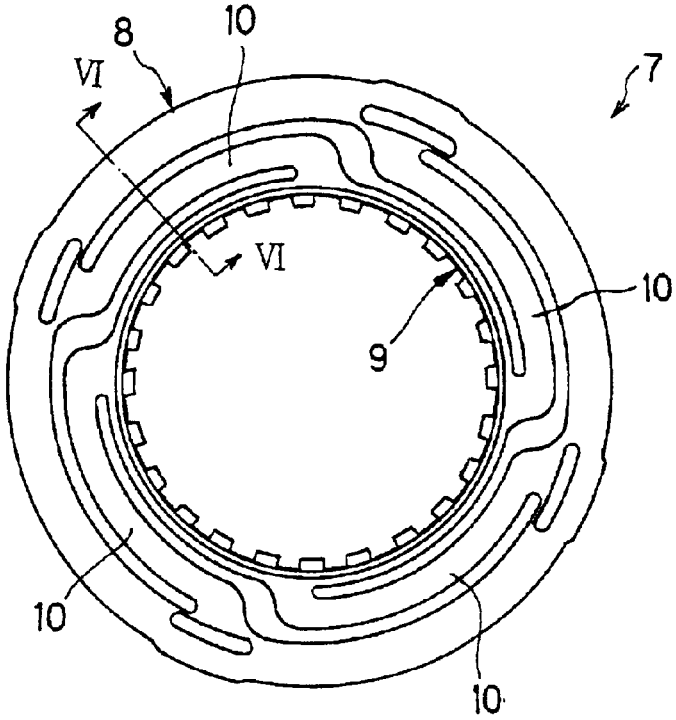
FIG. 5 PRIOR ART
FIG. 5 is a plan view illustrating the conventional butterfly damper.

Now, an embodiment of a butterfly damper of the present invention will be described in detail below with reference to the accompanying drawings. FIG. 1 is a plan view illustrating the butterfly damper of the present invention, FIG. 2 is a cross-sectional view cut along the line II—II in FIG. 1, FIG. 3 is an enlarged view illustrating the connecting portion of an arm member and an outer circumferential frame of the butterfly damper of the present invention, and FIG. 4 is a partial perspective view illustrating the butterfly damper of the present invention.

The butterfly damper 1 has an outer circumferential frame 2 having a ring-shape, an inner circumferential frame 3 and arm members 4, 4, 4 and 4. The inner circumferential frame 3 is disposed in the inside of the outer circumferential frame 2 and has a ring-shape. The arm members 4, 4, 4 and 4 are provided between the outer circumferential frame 2 and the inner circumferential frame 3.

The outer circumferential frame 2 has the outer peripheral surface 2*a*, the inner peripheral surface 2*c* and the opposite end surfaces. The inner peripheral surface 2*c* is connected to the opposite end surfaces to form the opposite connecting edge portions. The outer circumferential frame 2 is provided on the outer peripheral surface 2*a* with an engaging portion 2*b* having a recess into which the other structural component (for example, a framework of a loudspeaker) is to be fitted. One end of each of the arm members 4, 4, 4 and 4 is connected to the inner peripheral surface 2*c* of the outer circumferential frame 2 so that the arm members 4, 4, 4 and 4 are placed at prescribed intervals. The engaging portion 2*b* may not have the above-mentioned recess.

Each of the arm members 4, 4, 4 and 4 has an arm-main body 4*a*, which is formed into an S-shape so as to be placed between the outer circumferential frame 2 and the inner circumferential frame 3. The arm-main body 4*a* has an elastic deformation property so that the outer and inner circumferential frames 2 and 3 are elastically connected to each other. The arm-main body 4*a* has a central portion that is disposed between the outer and inner circumferential frames 2 and 3 so as to be substantially in parallel with them, and the opposite edges that have a bent-shape by which the opposite edges intersect the outer and inner circumferential frames 2 and 3 substantially at right angles and are connected thereto, respectively. Each of the opposite edges of the arm-main body 4*a*, which have the above-mentioned bent-shape, is provided with a projection 4*b* for enhancing strength of the arm-main body 4*a*. The one end of the arm member 4*a* is connected to the inner peripheral surface 2*c* of the outer circumferential frame 2 and the other end thereof is connected to the outer peripheral surface 3*c* of the inner circumferential frame 3. Each of the one end and the other end of each of the arm members 4, 4, 4 and 4 has curved surfaces in the vicinity of the connecting portion to, the outer or inner circumferential frame 2 or 3. The four arm members 4, 4, 4 and 4, which are disposed between the inner circumferential frame 3 and the outer circumferential frame 2 at the prescribed intervals, are symmetrical of rotation.

As shown in FIG. 3, in the butterfly damper 1 of the embodiment of the present invention, each of the arm members 4, 4, 4 and 4 has a racetrack-shaped cross section.

The other end of each of the arm members 4, 4, 4 and 4 is connected to the outer peripheral surface 3*c* of the inner circumferential frame 3 so that the arm members 4, 4, 4 and 4 are placed at prescribed intervals. The inner circumferential frame 3 is provided on its inner peripheral surface 3*b* with a plurality of projections 3*a* . . . 3*a*, which are placed at the prescribed intervals so as to extend toward the center of the inner circumferential frame 3. These projections 3*a* . . . 3*a* define a hole 5, which substantially coincides with the outside diameter of the voice coil, so that the voice coil can be fitted into the hole 5. Accordingly, the voice coil is supported on its outer peripheral surface by the above-mentioned projections 3*a* . . . 3*a*.

As shown in FIGS. 1 to 4, the one end of each of the arm members 4, 4, 4 and 4 is connected to a portion of the inner peripheral surface 2*c* of the outer circumferential frame 2, which portion excludes the above-mentioned opposite connecting edge portions of the outer circumferential frame 2. More specifically, the one end of the arm member 4 exists on the intermediate portion of the inner peripheral surface 2*c*, excluding the opposite connecting edge portions, in the operating direction (i.e., the vertical direction in FIGS. 2 and 3) of the damper 1. In other words, the upper surface of the one end of the arm member 4 is lower than the upper end surface of the outer circumferential frame 2 and the lower surface of the former is higher than the lower end surface of the latter, in the vertical direction in FIG. 3, so that the outer circumferential frame 2 projects upward from and downward below the above-mentioned one end of the arm member 1 in FIG. 2.

The inner circumferential frame 3, the outer circumferential frame 2 and the arm members 4, 4, 4 and 4 are formed of resin integrally with each other by the injection forming. Polypropylene or polybutylene terephthalate (PBT) is suitably used as the above-mentioned resin. A reason for application of the injection forming is that the thickness of the damper can appropriately be set by changing a mold(s) and the thickness thereof can also be increase or decreased partially, thus coping easily with change in design of the damper, in comparison with the conventional damper, which is formed by a punching method and has a limitation of thickness thereof due to the thickness of a blank sheet material, leading to difficulty in formation of the desired shape.

When strength required for the inner circumferential frame 3 and that required for the outer circumferential frame 2 are compared, the outer circumferential frame 2 requires a larger strength than the inner circumferential frame 3 in view of the fact that the outer circumferential frame 2 must bear oscillation caused by excitation of the voice coil, which is inserted into the inner circumferential frame 3. In addition, the inner circumferential frame 3, which is influenced by oscillation of the voice coil, requires flexibility. Accordingly, the outer circumferential frame 2 is preferably formed into a shape having the large cross-sectional area and the large thickness. On the contrary, the inner circumferential frame 3 is preferably formed into a shape having the smaller cross-sectional area and the smaller thickness than those of the outer circumferential frame 2.

Now, operation of the butterfly damper of the present invention will be described below.

The butterfly damper 1, which is composed of the outer circumferential frame 2, the inner circumferential frame 3 and the arm members 4, 4, 4 and 4 connecting the outer circumferential frame 2 and the inner circumferential frame 3 to each other, is fitted into the other structural component (for example, the framework of the loudspeaker) and fixed thereto so that the engaging portion 2*b* formed on the outer peripheral surface 2*a* of the outer circumferential frame 2 receives the other structural component. The voice coil is inserted into the hole 5 of the inner circumferential frame 3. The voice coil is supported resiliently by means of the projections 3*a* . . . 3*a* provided on the inner peripheral surface 3*b* of the inner circumferential frame 3 in this manner.

Excitation of the voice coil causes its oscillation in the operating direction (i.e., the vertical direction in FIG. 2) of the voice coil so that the inner circumferential frame 3 also reciprocates in synchronization with the above-mentioned oscillation of the voice coil. During a reciprocating motion of the inner circumferential frame 3, the arm members 4, 4, 4 and 4 connected to the outer peripheral surface 3*c* of the inner circumferential frame 3 is elastically deformed in synchronization with the reciprocating motion. Oscillation caused by the voice coil, which is supported by the inner circumferential frame 3, is absorbed by elastic deformation of the arm members 4, 4, 4 and 4 connected to the inner circumferential frame 3 during the excitation of the voice coil, while the outer circumferential frame 2 is stationarily supported.

Oscillation caused by the voice coil becomes larger, according as a value input into the voice coil becomes higher. Amplitude of the inner circumferential frame 3 also increases accordingly. In the conventional butterfly damper, increased amplitude of the inner circumferential frame 3 causes stress concentration on the connecting portions of the arm members 4, 4, 4 and 4 to the inner circumferential frame 3 and the outer circumferential frame 2, leading to a possible occurrence of breakage (or rupture) of the connecting portions.

In view of such problems, the arm member 4 has the racetrack-shaped cross section in the embodiment of the present invention. Such a cross sectional shape of the arm member 4 makes it possible to prevent concentration of stress and occurrence of fissures or cracks.

In the embodiment of the present invention, the one end of the arm member 4 exists on the intermediate portion of the inner peripheral surface 2*c*, excluding the opposite connecting edge portions, in the operating direction (i.e., the vertical direction in FIGS. 2 and 3) of the damper 1, in order to prevent the amplitude of the arm member 4 from increasing during excitation of the voice coil. Connecting the one end of the arm member 4 to the outer circumferential frame 2 in this manner makes it possible to restrict the movement of the arm member 4, which is caused by oscillation of the inner circumferential frame 3, through the outer circumferential frame 2. Thus, the amplitude of the arm member 4 can be decreased and consequently the amplitude of the inner circumferential frame 3 can also be decreased, thus reducing stress.

In the embodiment of the present invention, each of the one end and the other end of each of the arm members 4, 4, 4 and 4 has the curved surfaces in the vicinity of the connecting portion to the outer or inner circumferential frame 2 or 3. Formation of such curved surfaces makes it possible to distribute stress, thus preventing occurrence of fissures or cracks. Such a structure makes it possible to provide more effective results of prevention of stress concentration, in cooperation with the specific racetrack-shaped cross section of the arm member 4 (see FIG. 3).

Figure 6:
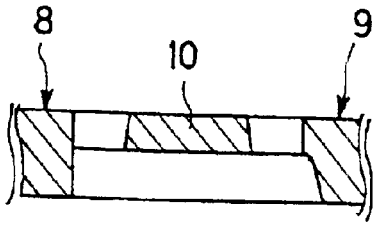
FIG. 6 PRIOR ART
FIG. 6 is a cross-sectional view cut along the line VI—VI in FIG. 5.

Stress was measured in a state in which the outer circumferential frame was stationarily supported and a prescribed load was applied to the inner circumferential frame, for each of the conventional butterfly damper and the butterfly damper of the present invention. Measurement results are shown in Table 1 below. Difference between the conventional butterfly damper and the butterfly damper of the present invention exists in that, as is clear from FIGS. 3 and 6, the arm member of the conventional butterfly damper has the trapezoidal cross section, and on the contrary, the arm member of the butterfly damper of the present invention has the racetrack-shaped cross section.

TABLE 1

| Kind of damper | Maximum stress ($N/cm^2$) | Maximum displacement (mm) | Variation (%) |
|---|---|---|---|
| Conventional | $1.93 \cdot 10^8$ | 1.81 | 100 |
| Present invention | $1.75 \cdot 10^8$ | 1.99 | 90 |

Measurement, results of which are shown in TABLE 1, was made, while applying load of 9 (N) to the inner circumferential frame. Polybutylene terephthalate (PBT) resin was used as material for forming the butterfly damper. As shown in TABLE 1, the maximum stress in the conventional butterfly damper was $1.93 \cdot 10^8$ ($N/cm^2$). On the contrary, the maximum stress in the butterfly damper of the present invention was $1.75 \cdot 10^8$ ($N/cm^2$). It is recognized from the results that stress was reduced by about 10%. The butterfly damper of the present invention used in the above-mentioned measurement had the same connecting structure of the arm member and the outer circumferential frame as the conventional butterfly damper, although it was provided with the arm members each of which had the racetrack-shaped cross section. Accordingly, it is expected that adoption of the specific connecting structure of the arm member and the outer circumferential frame as described in the embodiment may provide a further effective result of prevention of stress concentration.

Regions 6 and 6 in FIG. 4 denote portions in which stress concentration tends to occur. As shown in FIG. 4, stress concentration tends to occur in portions having the smaller curved surfaces in the vicinity of the connecting portions of the arm member 4 to the outer and inner circumferential frames 2 and 3, respectively. Also in the conventional butterfly damper, stress concentration tends to occur in portions in the vicinity of the connecting portions of the arm member to the outer and inner circumferential frames, respectively.

When load is applied in this manner, stress such as bending stress, which is to be applied to the arm member, tends to concentrate in an extended portion of the arm member (i.e., a connecting portion of the arm member, which is connected to the outer circumferential frame, in this case). In the butterfly damper of the present invention, the arm member 6 is provided, in the vicinity of the connecting portion, with the small curved surface, to which the maximum stress is applied. In the conventional butterfly damper, the arm member 10 has the trapezoidal cross section so that stress concentration occurs on the upper and lower surfaces of the arm member 10, thus making it impossible to distribute stress. In addition, the arm member 10 of the conventional butterfly damper is smoothly connected to the outer circumferential frame 8 so that the upper surface of the arm member 10 is flush with the upper surface of the outer circumferential frame 8. It is therefore presumed that force caused by the oscillation motion is transferred to the outer circumferential frame 8 so as to lift up slightly the outer circumferential frame 8, thus leading to an increased amplitude (displacement) and an increase stress. On the contrary, in the butterfly damper of the embodiment of the present invention, the one end of the arm member 4 is connected to the portion of the inner peripheral surface 2*c* of the outer circumferential frame 2, which portion excludes the opposite connecting edge portions of the outer circumferential frame 2, and more specifically, the one end of the arm member 4 exists on the intermediate portion of the inner peripheral surface 2*c*, excluding the opposite connecting edge portions, in the operating direction of the damper 1, and a further improvement in shape of the arm member is made to provide the racetrack shaped cross section. It is therefore presumed that stress is transmitted through the curved surfaces of the arm member in cross section so that the stress can be distributed and the amplitude can be decreased, thus reducing stress.

The present invention, which is not limited only to the above-described embodiment, can be carried out in the other embodiments. The number of arm members may be varied in an appropriate manner According to the present invention as described in detail, it is possible to provide the butterfly damper, which has a shape by which stress can be distributed and decreased in the portion in which stress tends to concentrate. Change in shape of the butterfly damper provides the technical effects of bearing a high input signal, without increasing a cost.

The entire disclosure of Japanese Patent Application No. 2001-55074 filed on Feb. 28, 2001 including the specification, claims, drawings and summary is incorporated herein by reference in its entirety.

What is claimed is:

1. A butterfly damper comprising:

an inner circumferential frame;

an outer circumferential frame; and at least one arm member having one end connected to said outer circumferential frame and an other end connected to said inner circumferential frame, wherein:

said at least one arm member has substantially a rectangular cross section with four curved corners having a predetermined radius of curvature, in a perpendicular direction to a longitudinal direction of said at least one arm member, wherein:

said outer circumferential frame has opposite end surfaces and an inner peripheral surface, said inner peripheral surface being connected to said opposite end surfaces to form opposite connecting circumferential edge portions; and said one end of said at least one arm member is connected to a portion of said inner peripheral surface of said outer circumferential frame, said portion excluding said opposite connecting circumferential edge portions so that a thickness of said at least one arm member is smaller than a thickness of said outer circumferential frame.

2. The butterfly damper as claimed in claim 1, wherein:

each of said one end and said other end of said at least one arm member has at least one curved surface.

3. The butterfly damper as claimed in claim 1, wherein:

a plurality of arm members are provided as said at least one arm member.

4. The butterfly damper as claimed in claim 2, wherein:

a plurality of arm members are provided as said at least one arm member.

5. The butterfly damper as claimed in claim 1, wherein:

said inner circumferential frame, said outer circumferential frame and said at least one arm member are formed of resin integrally with each other by an injection forming.

6. The butterfly damper as claimed in claim 2, wherein:

said inner circumferential frame, said outer circumferential frame and said at least one arm member are formed of resin integrally with each other by an injection forming.

7. The butterfly damper as claimed in claim 3, wherein:

said inner circumferential frame, said outer circumferential frame and said at least one arm member are formed of resin integrally with each other by an injection forming.

8. The butterfly damper as claimed in claim 4, wherein:

said inner circumferential frame, said outer circumferential frame and said at least one arm member are formed of resin integrally with each other by an injection forming.

* * * * *